United States Patent [19]

Cofer et al.

[11] 4,005,744

[45] Feb. 1, 1977

[54] APPARATUS FOR CONTINUOUS PICKLING OF CAST ROD

[75] Inventors: Daniel B. Cofer; Enrique Calixta Chia; John E. Burnitt; Theodor W. Kaltenberg, all of Carrollton, Ga.

[73] Assignee: Southwire Company, Carrollton, Ga.

[22] Filed: Jan. 10, 1975

[21] Appl. No.: 540,022

Related U.S. Application Data

[62] Division of Ser. No. 446,842, Feb. 28, 1974, which is a division of Ser. No. 109,421, Jan. 25, 1971, Pat. No. 3,806,366, which is a division of Ser. No. 808,976, March 20, 1969, Pat. No. 3,623,532.

[52] U.S. Cl. ..... 164/270

[51] Int. Cl.[2] ..... B22D 11/124

[58] Field of Search ..... 164/76, 270; 134/3, 134/15, 17, 28, 41, 60; 242/83, 157 R

[56] References Cited

UNITED STATES PATENTS

| | | | |
|---|---|---|---|
| 2,697,050 | 12/1954 | Barnes | 134/60 X |
| 2,926,001 | 2/1960 | Mack et al. | 242/157 R X |
| 3,333,452 | 8/1967 | Sendzimir | 164/76 X |
| 3,395,560 | 8/1968 | Cofer et al. | 242/83 X |
| 3,445,284 | 5/1969 | Robinson et al. | 134/3 |
| R21,261 | 11/1939 | Hazelett | 164/76 X |

*Primary Examiner*—John E. Roethel
*Attorney, Agent, or Firm*—Van C. Wilks; Herbert M. Hanegan; Stanley L. Tate

[57] ABSTRACT

A system for continuously quench-pickling cast rod from a continuous casting machine wherein molten metal is poured into a mold of a casting device and cooled and solidified into a continuous solid bar, the bar is elongated and reduced in its cross-sectional area to form continuous rod, and the rod is arranged in a coil. The surface of the hot rod from the rolling mill is contacted with a pickling fluid, such as a citric acid solution, after the rod leaves the rolling mill and before the rod is arranged in a coil, to simultaneously quench and pickle the rod.

12 Claims, 9 Drawing Figures

FIG.7
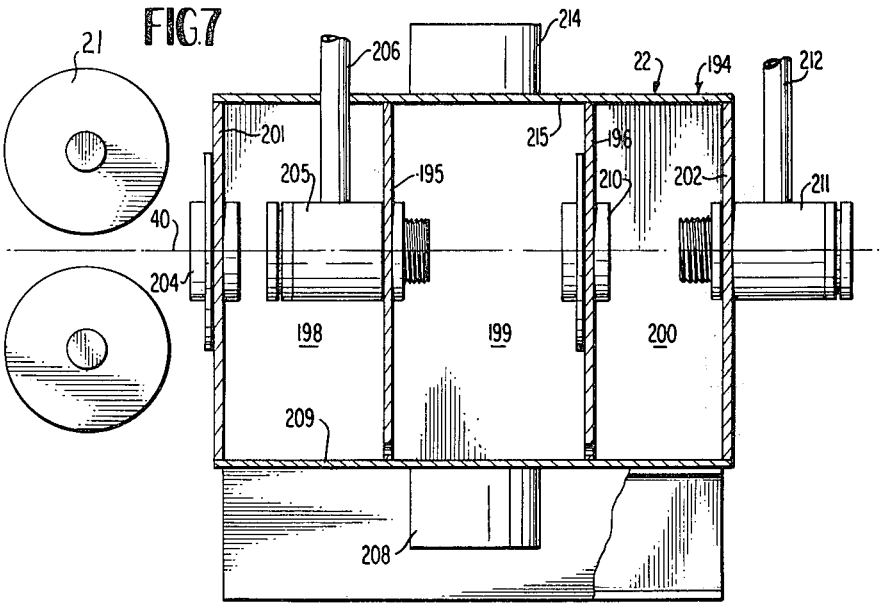
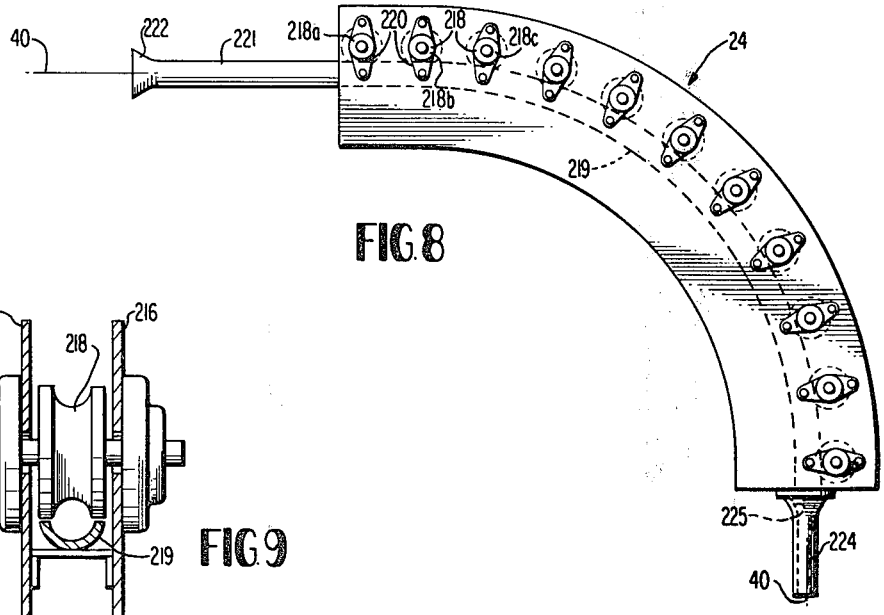
FIG.8
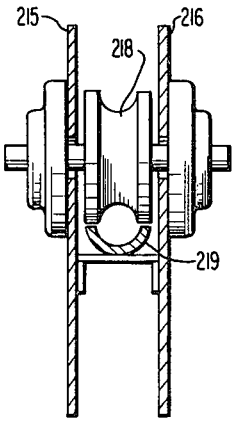
FIG.9

APPARATUS FOR CONTINUOUS PICKLING OF CAST ROD

This is a division of application Ser. No. 446,842, filed Feb. 28, 1974, which in turn is a division of application Ser. No. 109,421, filed Jan. 25, 1971, now U.S. Pat. No. 3,806, 366, which in turn is a division of application Ser. No. 808,976, filed Mar. 20, 1969, now U.S. Pat. No. 3,623, 532.

BACKGROUND OF THE INVENTION

Hot rolled copper or copper alloy rod used in the manufacture of wire is usually formed into coils for convenient handling. The rod accumulates a surface scale or oxide when exposed to the atmosphere, and the scale is of variable composition but usually includes a mixture of cuprous (red) and cupric (black) oxides. Before the rod with such an oxide scale is used in the manufacture of wire, the scale should be completely removed so that the wire drawn from the rod will not contain patches of oxide, and so the oxides will not form scratches and surface pits on the wire, and to increase the working life of the drawing tools used in the formation of the wire.

In order to remove surface scale or oxide from the surface of copper base products, it has become common practice to "pickle" the products by contacting their surfaces with a pickling liquid, such as a solution including sulphuric acid, nitric acid, or other acids. One of the common methods of pickling a copper product is to immerse the product in a heated bath of pickling liquid, such as a 20 percent solution of sulphuric acid for a period of time up to 30 minutes. When pickling copper or copper base rod, the rod is usually formed into a loosely coiled package with its annulus of a density of approximately 25 percent of the density of the rod and the rod is immersed in a pickling bath. The low density package allows the bath to circulate between the coils of the rod so that the acid solution contacts all surfaces of the rod and functions to dissolve the oxide. If the annulus of coils is more dense, the coils must be pulled apart in the bath to assure proper liquid circulation. The dilute sulphuric acid readily dissolves the black oxide component of the scale, but only slowly attacks the red oxide, and leaves harmful deposits of copper powder and undecomposed scale on the rod. When the coils of rod are raised from the pickling bath, a high velocity stream of liquid must be applied to the coils to beat a portion of the remaining red oxide from the surface of the rod. The coils are subsequently immersed in water to remove the acid from the surface of the rod. When the surface of the copper rod has been deoxidized in this manner, the rod can be stored and handled for extended periods of time, maybe 4 to 6 weeks, substantially without reoxidizing.

Other descriptions of pickling copper products are set forth in U.S. Pat. No. 2,291,201 and in WIRE, Coburg, Germany, Issue 90, August, 1967.

While the foregoing process of immersing copper rod in a pickling bath to remove surface oxide from the rod has been found to be successful to a limited extent, this pickling process is expensive in that it requires the use of heating equipment, large tanks of acid solution and water, handling equipment, plant space, and operators to perform the process.

SUMMARY OF THE INVENTION

Briefly described, the present invention comprises a method and apparatus for continuously quench-pickling cast rod in a continuous casting process. The hot rod is quenched with a pickling fluid such as a 15 percent solution of citric acid and other copper salts after the rod leaves the rolling mill and before it reaches the coiler in such a manner that the pickling and quenching process is completed before the rod is coiled. The pickling process utilizes the heat of the rod as the rod is received from the rolling mill to avoid the necessity of heating the pickling fluid to speed up the reaction, and the quenching of the rod with the pickling liquid functions to rapidly contract the rod and oxide to burst off a significant proportion of the oxides and to allow the pickling liquid to penetrate the surface of the rod and reach and react with the deeply rooted oxides during the moment when the contractions occur.

Thus, it is an object of this invention to provide a method and apparatus for continuously quench-pickling cast rod.

Another object of this invention is to provide a method and apparatus for pickling cast rod which utilizes the heat of the rod as it leaves the rolling mill to assist in the pickling process.

Another object of this invention is to provide a method and apparatus for quench-pickling a copper product in a continuous process which avoids the separate step of immersing the product in a pickling fluid.

Another object of this invention is to provide apparatus for continuously pickling cast copper rod in a continuous casting system which is inexpensive to construct, maintain, and operate.

Other objects, features, and advantages of the present invention will become apparent upon reading the following specification, when taken in conjunction with the accompanying drawing.

BRIEF DESCRIPTION OF THE DRAWING

FIG. 7 is a side cross-sectional view of the wax applicator of the continuous pickling system.

FIG. 8 is a side cross-sectional view of the rod guide mechanism for guiding the cast rod toward the coiler.

FIG. 9 is an end cross-sectional view of the rod guide mechanism of FIG. 8.

DESCRIPTION OF THE PREFERRED EMBODIMENT

Figure 1:
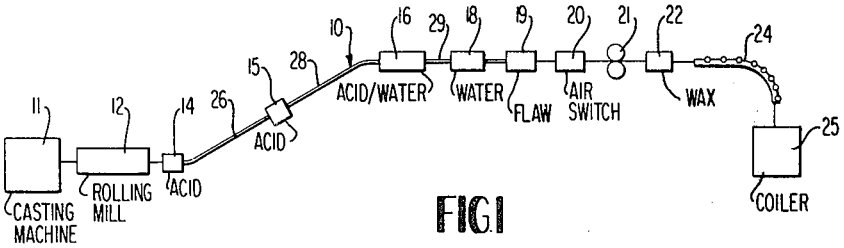
FIG. 1 is a schematic side elevation view of a continuous casting system, showing the continuous pickling apparatus.

Referring now in more detail to the drawings, wherein like numerals indicate like parts throughout the several views, FIG. 1 shows continuous casting system 10 which includes casting machine 11, rolling mill 12, acid drain box 14, middle acid injector 15, acid injector and water drain 16, water injector 18, flaw detector 19, air limit switch 20, pinch rolls 21, wax applicator 22, rod guide mechanism 24, and coiler 25. Molten metal is formed into cast bar in casting machine 11, the bar is rolled in rolling mill 12 which reduces the cross-sectional area of the bar and lengthens the bar to form cast rod, and the cast rod is then processed through the pickling apparatus 14-24. Acid drain box 14, middle acid injector 15, acid injector and water drain 16, and water injector 18 are all connected to each other by rod conduits 26, 28, and 29. The rod from rolling mill 12 passes through these conduits and is processed through pickling apparatus 14-24. As the rod moves toward coiler 25, a flow of water is created between water injector 18 and acid injector and water drain 16 through rod conduit 29, and a flow of acid is created between acid injector and water drain 16 and middle acid injector 15 through rod conduit 28, and from middle acid injector 15 to acid drain box 14 through rod conduit 26. Thus, the water and acid utilized in pickling apparatus 14-24 is placed in a counter flow relationship with the rod passing through the system. When the rod is received from rolling mill 12, its temperature is approximately 1,000° F. The temperature of the pickling acid and water in the pickling apparatus 14-24 is significantly lower than that of the rod, and the pickling acid serves to simultaneously quench and pickle the rod. The counter flow relationship of the pickling acid and water with respect to the rod movement provides optimum cooling characteristics in the system.

ACID DRAIN BOX

Figure 3:
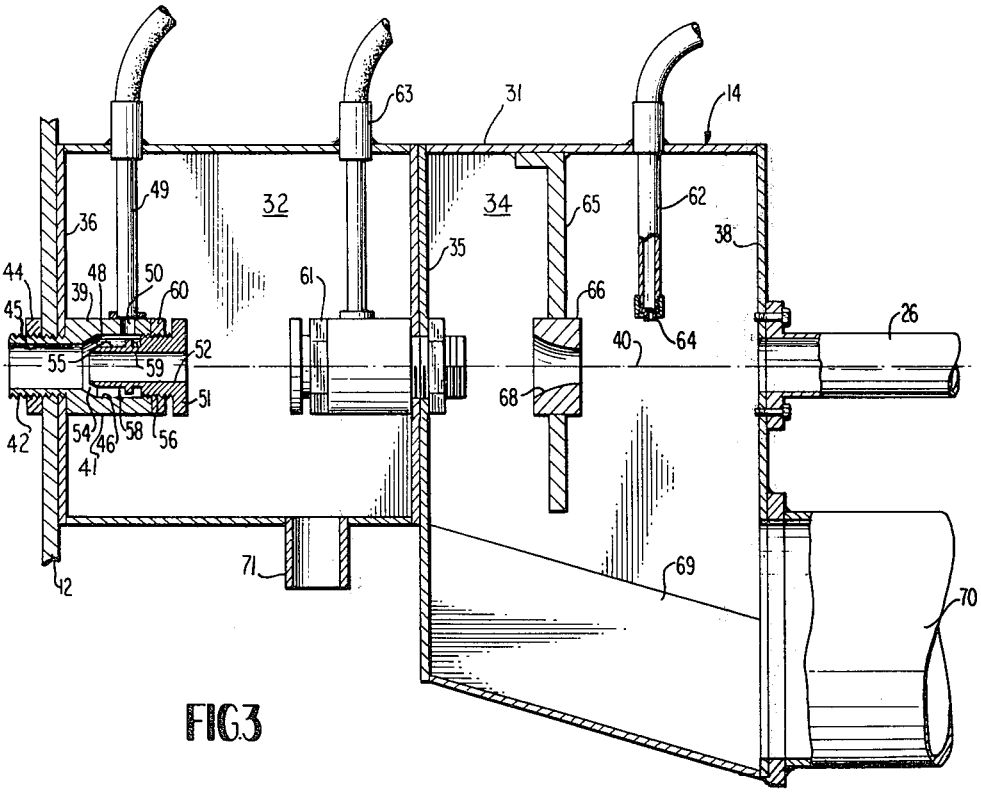
FIG. 3 is a side cross-sectional view of the acid drain box of the continuous pickling system.

As is shown in FIG. 3, acid drain box 14 comprises housing 31 which is divided into air chamber 32 and acid knock-down chamber 34 by partition 35. Housing 14 abuts the housing of rolling mill 12, and entrance wall 36, exit wall 38, and partition 35 each define aligned apertures for receiving rod from the rolling mill.

Air nozzle 39 which can be used with air, steam or other gases is positioned in air chamber 32 and extends through the opening of entrance wall 36. Air nozzle 39 surrounds the path 40 through which the rod from rolling mill 12 is to pass. Air nozzle 39 includes cylindrical housing 41 located in abutment with entrance wall 36 and small diameter threaded portion 42 protrudes through the opening of entrance will 36 into the housing of rolling mill 12. Nut 44 engages the external threads of threaded portion 42 to hold air nozzle 39 in place. Cylindrical housing 41 defines opening 45 which is placed in alignment with the path of travel 40 of the rod, and opening 45 is counter-bored at 46. Counterbore 46 and opening 45 merge together by means of tapered portion 48. Air supply pipe 49 communicates with counter-bore 46 through port 50 in air nozzle housing 41. Nozzle insert 51 is threaded into counterbore 46 and defines rod opening 52 which is in alignment with path 40 and rod opening 45 of air nozzle housing 41. The inner end of nozzle 51 defines tapered portion 54 which is sized and shaped to mate with tapered portion 48 of air nozzle housing 41. The diameter of nozzle insert 51 is substantially equal to the diameter of counter-bore 46 of air nozzle 41 at their respective threaded portions, and nozzle insert 51 is reduced in its outside diameter at 55, between tapered portion 54 and threaded portion 56. Thus, an annular supply chamber 58 is defined between nozzle insert 51 and air nozzle housing 41, which communicates with air supply pipe 49. Flange 59 extends radially outwardly from the reduced diameter portion of nozzle insert 51 into annular supply chamber 55, and flange 59 is notched at spaced intervals around its periphery. Flange 59 functions as a control flange and is normally positioned in the vicinity of port 50 of air nozzle housing 41. When nozzle insert 51 is moved to its fullest extent into air nozzle housing 41, flange 59 will move beyond port 50, and restrict the flow of fluid from air supply pipe 49. Also, the tapered portion 54 of nozzle insert 41 will be placed closely adjacent the tapered portion 48 of air nozzle housing 41, which also functions to limit the flow of fluid from annular supply chamber 58 into rod opening 45 of air nozzle 41. Thus, when high pressure air, steam or other gas is flowing through air supply pipe 49 from the air supply, its volume of flow and flow velocity into rod opening 45 can be controlled by moving nozzle insert 51 inwardly or outwardly of air nozzle housing 41. Once a desired setting has been attained, lock nut 60 can be rotated on the threads of nozzle insert 51 and forced against air nozzle housing 41 to lock nozzle insert 51 in place.

Air nozzle 39 functions to receive rod from rolling mill 12 through its rod opening 45, and to wipe or impinge the surface of the rod with an annular flow of air directed generally in the direction opposite to the direction of movement of the rod through air nozzle 39 and housing 31. If any liquid, such as soluble oil from rolling mill 12, is present on the surface of the rod, the flow of air through air nozzle 39 will tend to wipe the liquid off the surface of the rod, so that the rod received in housing 31 will generally be dry and free of oil.

As the rod moves along path 40 and passes from air nozzle 39 through housing 31, it will enter air nozzle 61 which is similar to air nozzle 39, but attached to partition 45 so that it flows air along the length of the rod generally from air chamber 32 into acid knock-down chamber 34.

Acid supply pipe 62 extends into acid knock-down chamber 34 and projects toward path 40. Acid supply pipe 62 terminates in nozzle 64 which functions to direct a spray of acid across path 40. Acid supply pipe communicates with a source of high pressure acid, and the spray emitted by nozzle 64 is a high velocity spray which functions to impinge upon the rod passing through acid drain box 14. Air nozzle 61 prevents the acid from acid knock-down chamber 34 from entering air chamber 32. Baffle plate 65 defines an aperture which surrounds path 40, and guide socket 66 is located in the aperture and functions to guide the lead end of the rod initially entering the system from air nozzle 61 along path 40. Guide socket 66 defines an annular converging opening 68 for this purpose.

The bottom wall 69 of acid knock-down chamber 34 slopes in a downward direction to form a catch basin for the acid flowing through acid supply pipe 62, and drain pipe 70 is connected to exit wall 38 and communicates with the catch basin to drain acid knock-down chamber 34. Drain pipe 71 communicates with air chamber 32 and functions to drain away any liquid present in this chamber. In some instances, the fluid flowing through air nozzles 39 and 61 will be steam or some other saturated gas, which may leave a residue of liquid in air chamber 32.

Rod conduit 26 is connected to exit wall 38 of housing 31 and extends toward middle acid injector 15. Rod conduit 26 is in alignment with path 40 of the rod and is of larger internal diameter than the external diameter of the rod. Middle acid injector 15 functions to flow acid through rod conduit 26 into acid knock-down chamber 34 of acid drain box 14. Thus, the additional acid flowing through rod conduit 26 into housing 31 will be drained away from housing 31 by drain pipe 70.

MIDDLE ACID INJECTOR

Figure 4:
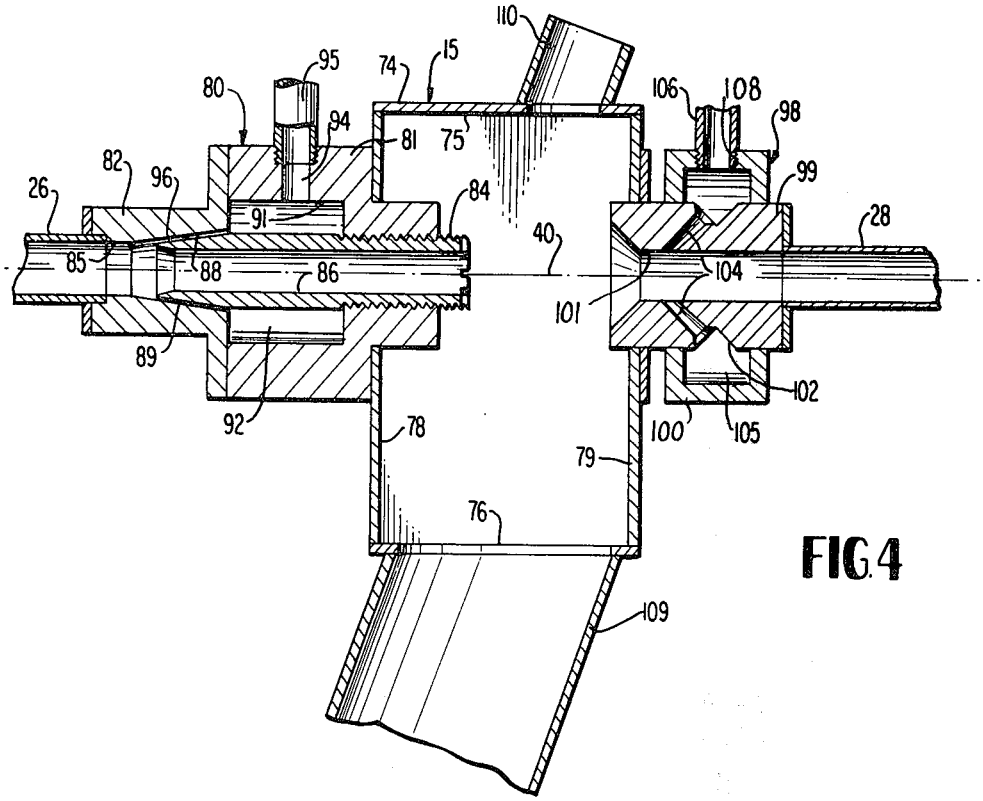
FIG. 4 is a side cross-sectional view of the middle acid injector of the continuous pickling system.

As is best shown in FIG. 4, middle acid injector 15 comprises housing 74 which includes top wall 75, bottom wall 76, entrance wall 78, and exit wall 79. Entrance wall 78 and exit wall 79 define aligned apertures positioned in alignment with rod path 40. Acid injector nozzle 80 is connected to entrance wall 78 and includes nozzle housing 81, nozzle adapter 82, and nozzle insert 84. Adapter 82 and nozzle insert 84 each define rod openings 85 and 86 which are in alignment with rod path 40. Rod opening 85 of adapter 82 flares into tapered portion 88 while the outer surface of insert 84 converges into tapered portion 89 which is sized and shaped to mate with tapered portion 88. Housing 81 defines threaded bore 90, into which insert 84 is threaded, and the counter bore 91. The annular space between insert 84 and counter bore 91 comprises annular supply chamber 92, and port 94 is connected to acid supply pipe 95 and opens into annular supply chamber 92. The acid supply pipe 95 functions to communicate a source of high pressure acid with annular supply chamber 92, and the acid flowing to annular supply chamber 92 flows between tapered portions 88 and 89 of adapter 82 and insert 84, into rod opening 85 of adapter 82, and along path 40 of the rod. The direction of flow of the acid flowing through the tapered annular orifice 96 formed by tapered portions 88 and 89 is generally along the length of path 40 into rod conduit 26, which functions to create a flow of acid through rod conduit 26 along the length of the rod, toward acid drain box 14 in a counter flow relationship with respect to the movement of the rod.

Acid flow accelerator 98 is connected to exit wall 79 of housing 74, and comprises nozzle spool 99 and housing 100. Nozzle spool 99 extends through the opening of exit wall 79 and defines opening 101 along its length, which is in alignment with path 40. Annular groove 102 is cut in the external surface of nozzle spool 99, and a plurality of aperatures 104 extend from annular groove 102 toward rod opening 101, at an angle extending toward housing 74. Acid flow accelerator housing 100 surrounds annular groove 102, and an annular supply chamber 105 is defined between housing 100 and nozzle spool 99. Acid supply pipe 106 communicates with port 108 which opens into annular supply chamber 105, and acid under pressure is supplied to annular supply chamber 105 and flows through apertures 104 into rod opening 101. Apertures 104 are arranged so that the velocity of the acid flowing into rod opening 101 is in the direction of housing 74, which induces a fluid flow through rod opening 101 toward housing 74. Thus, any liquid present in rod conduit 28 will be induced to flow toward housing 74.

Drain conduit 109 is connected to housing 74 through bottom wall 76 and vent opening 110 is connected to housing 74 through top wall 75. Thus, any acid received in housing 74 from acid flow accelerator 98 or from rod conduit 28 will be drained away from housing 74 by drain conduit 109, and the gases present in housing 74 will be allowed to exhaust through vent conduit 110.

ACID INJECTOR AND WATER DRAIN

Figure 5:
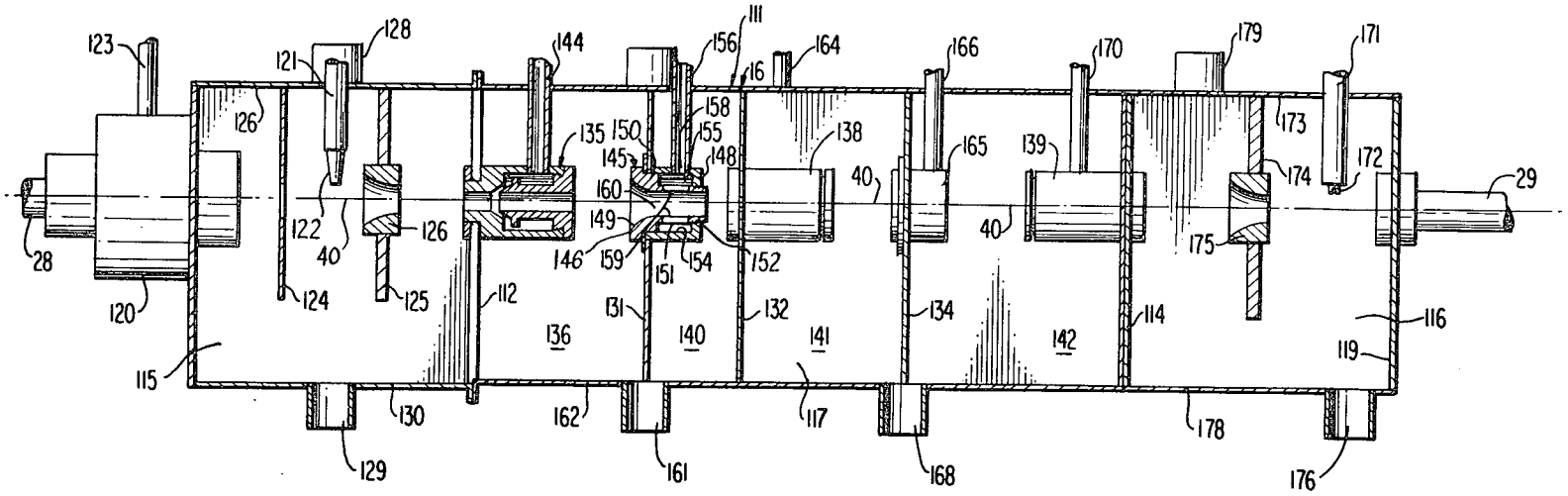
FIG. 5 is a side cross-sectional view of the acid injector and water drain of the continuous pickling system.

As is best shown in FIG. 5, acid injector and water drain 16 comprises housing 111 which is divided by partitions 112 and 114 into acid injection chamber 115, water injection chamber 116, and separator chamber 117. Aligned apertures are formed in entrance wall 118, exit wall 119, and partition walls 112 and 114, and the various baffles and dividers in housing 111 around rod path 40. Acid injector nozzle 120 is connected to entrance wall 118 of acid injection chamber 115. Acid injector nozzle 120 is similar to acid injector nozzle 80 of middle acid injector 15, and functions to flow acid into contact with and along the length of the rod passing through rod conduit 28 into housing 111. The flow of acid from acid injector nozzle 120 is through rod conduit 28 toward middle acid injector 15, and the acid flowing through conduit 28 flows into housing 74 of middle acid injector 15.

Acid supply pipe 121 extends into acid injection chamber 115, and terminates in nozzle 122. Acid supply pipe communicates with a source of high pressure acid, and nozzle 122 creates a high pressure knock-down spray which is directed toward tod path 40 and which functions to impinge acid on the rod passing through housing 111. Baffles 124 and 125 are suspended from top wall 126 of acid injection chamber 115 and are disposed on opposite sides of acid supply pipe 121. Guide socket 126 is placed in baffle 125 and functions to guide the lead end of the rod along path 40. Baffles 124 and 125 function to confine the major portion of the spray and splashing of acid from acid supply pipe in the center portion of acid injection chamber 115. Vent conduit 128 also extends through top wall 126, and vents gases from acid injection chamber 115. Drain conduit 129 is connected to bottom wall 130 of acid injection chamber 115 and functions to drain the acid accumulated in acid injection chamber 115.

Separator chamber 117 is divided into four sub-chambers by baffles 131, 132, and 134. Air nozzle 135 is connected to partition 112 and is positioned in sub-chamber 136. Air nozzles 138 and 139 are connected in baffle 132 and partition 114, respectively, in sub-chambers 141 and 142, respectively. Air nozzles 135, 138 and 139 are similar to air nozzle 39 of acid drain box 14 (FIG. 3). Air nozzle 135 is arranged to flow air from air supply pipe 144 and a sub-chamber 136 through partition 112 into acid injection chamber 115. The flow of air in this direction functions to wipe the acid from the surface of the rod as the rod passes through partition 112 so the acid falls into acid injection chamber 115.

After the rod leaves air nozzle 135, it passes through water nozzle 145 which is supported by baffle 131. Water nozzle 145 includes nozzle insert 146 and nozzle housing 148. Nozzle insert includes enlarged flange 149, body portion 150, and reduced diameter portion 151. Flange 149 is positionable on one side of baffle 131, and body portion 150 and reduced diameter portion 151 extend into sub-chamber 140. Nozzle housing 148 defines threaded bore 152 and counter-bore 154. Threaded bore 152 threads onto reduced diameter portion 151 of nozzle insert 146, and counter-bore 154 defines with reduced diameter portion of insert 146 annular supply chamber 155. Water supply pipe 156 communicates with a source of water under pressure and through port 158 in nozzle housing 148, with annular supply chamber 155. A series of slots 159 are defined in reduced diameter portion 151 of nozzle insert 146, which open into rod opening 160 of insert 146. Thus, the water supply to the annular supply chamber 155 passes through slots 159 and into slot opening 160. In this manner, the rod passing along path 40 and through rod opening 160 of water nozzle 145 is inundated with high pressure water. The arrangement of slots 159 is such that the water emerging from water nozzle 145 will flow into sub-chamber 140. Waste drain 161 is connected to bottom wall 162 of separator chamber 118 and communicates with sub-chambers 136 and 140 to drain any water and acid accumulating in these chambers.

Air nozzle 138 is connected to baffle 132 in such a manner that the air flowing from air conduit 164 into sub-chamber 141 and air nozzle 138 flows in through baffle 132 into sub-chamber 140, which functions to wipe the water from the surface of the rod as it passes through baffle 132. The water from the rod then falls into sub-chamber 140 and is drained away through waste drain 161.

Water nozzle 165 is similar to water nozzle 145 and is connected to baffle 134. The water flowing to water nozzle 165 through water supply pipe 166 impinges upon the red passing along path 40 and falls into sub-chambers 141 and 142. Water drain 168 is connected to bottom wall 162 and communicates with both sub-chambers 141 and 142, and functions to drain the water from these chambers.

Air nozzle 139 is connected to partition 114 in such a manner that the air flowing through air supply pipe 170 passes through sub-chamber 142 and air nozzle 139 into water injection chamber 116.

Water injection chamber 116 includes water supply pipe 171 which is connected to a source of high pressure water and which terminates in nozzle 172. Nozzle 172 is positioned adjacent to rod path 40, and functions to create a high pressure water knock-down spray which functions to impinge high velocity water on the rod passing through water injection chamber 116. Baffle 174 is suspended down from top wall 173, and guide socket 175 is positioned in concentric relationship with path 40, and functions to guide the leading end of the rod along path 40. Baffle 174 functions to isolate the major portion of water turbulence from the water knock-down spray away from vent 179. Drain conduit 176 is connected to bottom wall 178 of water injection 116, and functions to drain the water away from this chamber. Vent conduit 179 is connected to top wall 173, and functions to exhaust the gases from water injection chamber 116. Rod conduit 29 is connected to exit wall 119, and rod conduit 29 is of larger diameter than the rod which is to be passed through housing 111.

WATER INJECTOR

Figure 6:
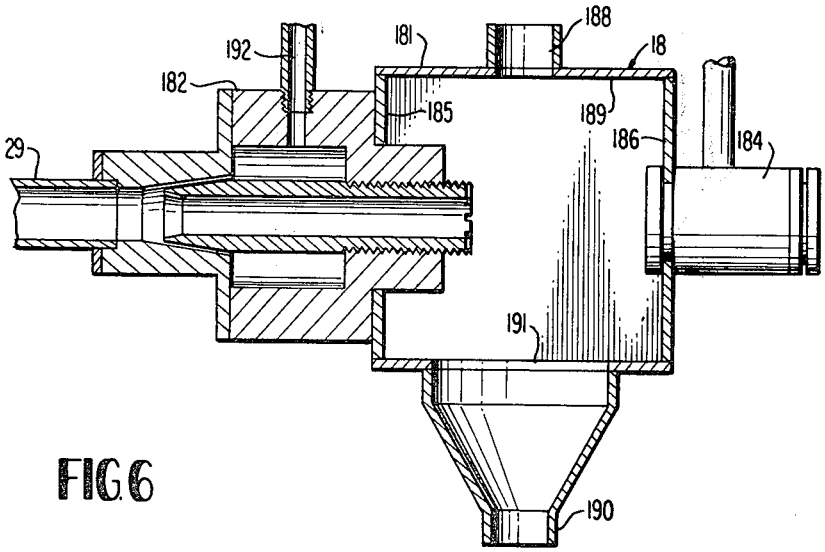
FIG. 6 is a side cross-sectional view of the water injector of the continuous pickling system.

As is best shown in FIG. 6, water injector 18 comprises housing 181, water nozzle 182, and air nozzle 184. Water nozzle 182 is connected to entrance wall 185 and is similar to acid injector nozzle 80 of FIG. 4. Air nozzle 184 is connected to exit wall 186 and is similar to air nozzle 39 of FIG. 3. Vent conduit 188 is connected to top wall 189 of housing 181, and drain conduit 190 is connected to bottom wall 191 of housing 181. Water inlet conduit 192 communicates with the source of high pressure water and flows water into contact with and along the length of rod passing through water injector 18. The direction of flow of the water passing from water injector 182 is from housing 181 through rod conduit 29 back toward water injection chamber 116 of acid injector and water drain 16. The flow of air from air nozzle 184 is toward housing 181, and the flow functions to wipe the water from the rod passing through housing 181 so that the water falls to the bottom of housing 181 and flows out drain conduit 190.

MAX APPLICATION

As is best shown in FIG. 7, wax applicator 22 comprises housing 194 which is divided by baffles 195 and 196 into chambers 198, 199, and 200. Entrance wall 201, exit wall 202, and baffles 195 and 196 each define aligned openings about rod path 40, so that the rod can pass through housing 194. Guide socket 204 is supported in entrance wall 201 and functions to guide the leading end of the rod along path 40. Wax nozzle 205 is positioned in chamber 198 and supported from baffle 195. Wax nozzle 205 is similar to air nozzle 39 of FIG. 3, and wax supply conduit 206 communicates with a source of wax under pressure and with wax nozzle 205, to supply wax nozzle 205 with liquid wax. The arrangement of wax nozzle 205 is that the wax flows onto and along the surface of the rod passing along path 40, generally in the direction from chamber 198 into chamber 199. Drain conduit 208 is connected to bottom wall 209 of housing 194, and the wax falling away from the rod is drained from housing 194 and recirculated to wax supply pipe 206. Guide socket 210 is positioned in baffle 196 and functions to guide the leading end of the rod along path 40. Baffles 195 and 196 function to confine the major portion of the turbulance of the wax passing from wax nozzle 205 within chamber 199.

Air nozzle 211 is connected to exit wall 202 of housing 194 and is similar to air nozzle 39 of FIG. 3. Air nozzle 211 is connected to air supply conduit 212, and is arranged to flow air from outside housing 194 through exit wall 202 and into the chamber 200. The flow of air through the air nozzle 211 functions to wipe the wax from the surface of the rod passing through housing 194, so that the rod will be relatively dry as it energes from air nozzle 211. Vent conduit 214 is connected to top wall 215 of housing 194 and functions to exhaust air gases from housing 194.

ROD GUIDE MECHANISM

As is best shown in FIG. 8, the rod passing from wax applicator 22 passes into rod guide mechanism 24, which functions to guide the rod from a substantially horizontal direction of movement toward a substantially vertical direction of movement. As it is shown in FIG. 9, rod guide mechanism 24 includes arcuate side plates 215 and 216 which support a series of spaced rollers 218, and arcuate rod conduit 219. Arcuate rod conduit 219 is generally tubular and defines a series of spaced slots 220 along its upper convex surface. Rollers 218 are supported by arcuate side plates 215 and 216 so that their peripheries extend into slots 220. The arrangement is such that the concave inner portion of the arc defined by the inner surface of rod conduit 219 around the arc formed by rod guide mechanism 24 has a series of rollers displaced inwardly from the concave surface. The rod passing through rod conduit 19 normally engages the concave surface of the arc formed by rod conduit 19 except for the presence of rollers 218. Rollers 218 function to hold the rod away from the surface of rod conduit 219, and isolate and rod from the sliding friction it normally would encounter when it engages the surface of rod conduit 219. Rollers 218 are mounted on ball bearings and are relatively friction-free. Thus, the rod passing through rod guide mechanism 24 is directed through a 90° arc with a minimum of friction.

Rollers 218 are spaced at approximately 10° intervals from each other through the arc defined by the rod guide mechanism. This close spacing of the rollers is such that the initial leading end of the rod passing through the system will normally not engage the surface of rod conduit 219 of rod guide mechanism 24, but will be positively guided in a downward direction by the rollers. In the event that the leading end of the rod is deformed and difficult to manage in rod guide mechanism 24, the slotted arrangement of rod guide conduit 219 is such that the inner concave surface of the rod guide conduit that the rod would normally engage in a tube without rollers functions to assure that the leading end of the rod is guided properly to the next roller and the rod won't pass on the wrong side of the roller or pass toward the axis of the roller.

Entrance guide tube 221 is connected to arcuate rod conduit 219 along rod path 40. The end 222 of entrance guide tube 221 adjacent wax applicator 22 is flared outwardly and functions to receive the leading end of the rod passing along path 40 and guide the rod into rod guide mechanism 24. Similarly, exit guide tube 224 is positioned adjacent the vertical end of rod guide mechanism 24, and includes a flared end 225 which receives the rod from rod guide mechanism 24. Exit guide tube 224 guides a rod in a vertical direction toward the coiler 25.

Rollers 218*a* and 218*b* at the horizontal end of rod guide mechanism 24 are in horizontal alignment with entrance guide tube 221. Roller 218*b* is the first roller in the series of rollers which is positioned in the 90° arc between entrance guide tube 221 and exit guide tube 224. The subsequent rollers in rod guide mechanism 24 are positioned at a constant radius of curvature within the arc defined by rod guide mechanism 24. Thus, rollers 218*a* and 218*b* function to positively receive the rod passing through rod guide mechanism 24 before rod guide mechanism 24 imparts a curve to the rod. This prevents entrance guide tube 221 from encountering any significant sliding motion with respect to the rod.

The rod passing through the exit guide tube 224 from rod guide mechanism 24 will have some curve imparted thereto due to its passage through rod guide mechanism 24; however, the weight of the rod extending in a vertical direction below exit guide tube 224 is such that it tends to straighten the rod and remove the curvature therefrom. Thus, the curvature of the rod is not of a significant problem and does not function to damage exit guide tube 224 or engage exit guide tube 224 with significant friction. Furthermore, the rod coiling mechanism 25 functions to guide the rod in a vertical downward direction from exit guide tube 224.

FLOW SYSTEM

Figure 2:
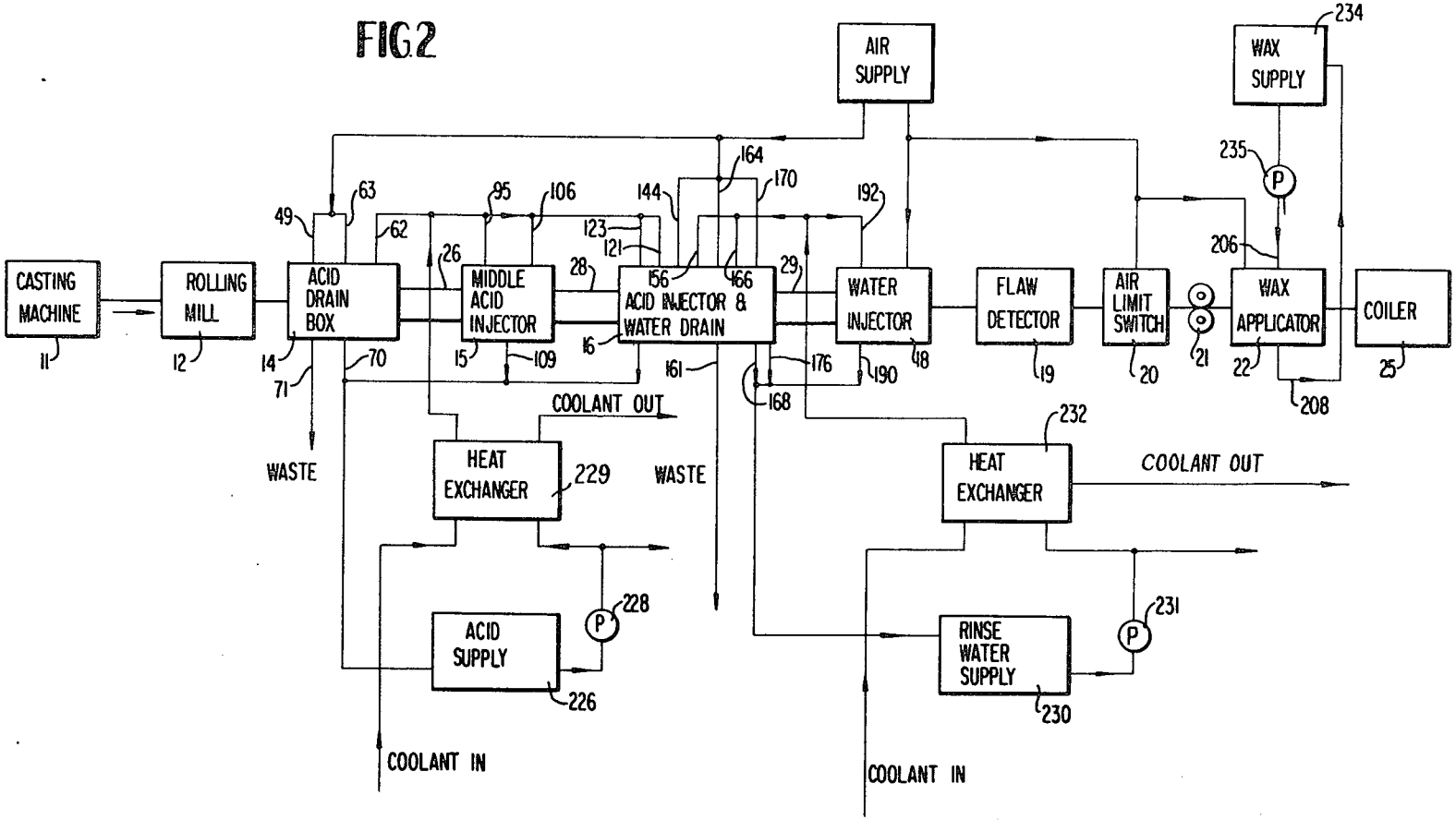
FIG. 2 is a schematic block diagram of the continuous pickling apparatus.

As is best shown in FIG. 2, acid drain box 14, middle acid injector 15, and acid injector and water drain 16 are supplied with acid from acid supply tank 226 through a series of conduits. Pump 228 passes the acid from acid supply tank 226 through heat exchanger 229 to the various acid supply pipes of the system. Cool water is flowed through heat exchanger 229 to maintain the acid in a relatively cool state. Of course, the acid picks up heat from the rod as it passes through the system, and must be cooled again in heat exchanger 229 before its reuse. Various valves are placed in the acid supply lines to regulate the flow of the acid passing through the various components of the system.

Water supply tank 230 provides water for the various elements that utilize water in the system. Pump 231 passes water from water supply tank 230 through heat exchanger 232, and then to the various water conduits in the system. Valves are provided in the conduit for regulating the flow of water. Cool water is passed through heat exchanger 232 to maintain the water used in the system at a relatively cool temperature. Of course, the water is recirculated from the system, and must be cooled again in heat exchanger 232 before its reuse.

Wax supply tank 234 provides a source of liquid wax for wax applicator 22. Pump 235 flows the wax from wax supply tank 234 to wax applicator 22 and the wax is recirculated back to supply tank 234.

Conduit 71 of acid drain box 14 and conduit 161 of acid injector and water drain are the only conduits which duct waste material away from the system. The remaining liquids of the system are recirculated and reused.

Flaw detector 19 is positioned downstream of water injector 18 at a point where the rod emerging from the system has been pickled and cleaned and reduced in temperature, and if any flaws are present in the rod, flaw detector 19 is positioned at an optimum location for its detection function.

Air limit switch 20 is positioned adjacent flaw detector 19, and functions to cause pinch rollers 21 to engage the rod as it passes through the system. Pinch rollers 21 function to create a tension in the rod back toward rolling mill 12, so that no cobbles or flaws will occur in the rod. Furthermore, pinch rollers 21 assure that the rod will pass through rod guide mechanism 24 without having any friction from rod guide mechanism 24 being transmitted back toward rolling mill 12.

Wax applicator 22 is positioned just ahead of rod guide mechanism 24 and functions to apply the wax material on the surface of the rod before the rod enters rod guide mechanism 24. Thus, the rod not only has an oxidizing inhibitor applied to its surface but the surface of the rod passing through rod guide mechanism 24 has relatively low coefficients of sliding and rolling friction, which tends to further reduce the possibility of the rod cobbling in the system.

The concentration of the copper in solution in acid supply tank 226 is controlled by the use of an electrolytic cell (not shown) during the recirculation of the acid through the system. The regeneration of the acid is proportional to the amount of copper taken out of the acid by the cell. Thus, the acid is continuously reconditioned so as to be suitable in the pickling process.

To supplement the operation of the electrolytic cell, suitable sequestering and complexing agents can be added to the bath, such as sodium citrate, ammonium hydroxide, and creme of tartar. These agents help to control the pH of the pickling solution, increase the solubility of copper complex and avoids salt precipitation, improve current conductivity within the pickling solution, and extend the operating parameters of the pickling solution. For instance, if a 10 percent citric acid solution is adjusted by adding sodium citrate until the pH of the solution is changed from pH 1.85 to pH 4.00,then the reaction equilibrium is shifted so that the copper solubility of the acid becomes approximately 40.00 gms cu ++/1, as opposed to 5.0 gms cu ++/1 for pH 1.85.

In the present system, a 10 to 15 percent concentration citric acid solution is utilized as the pickling acid. This particular pickling liquid has been found to be inexpensive, safe and easy to handle, and performs a superior pickling function with the system. When the system is producing as much as 30 tons of rod per hour, 336 gallons per minute of pickling acid and water have been pumped through the system which included a wet path of approximately 40 feet of rod travel with a counterflow relationship. The characteristics of the rod were found superior to rod characteristics normally created by the previously known immersion pickling process and the rod emerged from the pickling apparatus at a temperature of less than 200 degrees Fahrenheit. Of course, various other volumes of pickling liquid and water can be utilized, along with different lengths of wet path to achieve approximately the same results, with the only limitations appearing to be that enough pickling acid of high enough concentration must be utilized to sufficiently react with the copper oxide of the surface of the rod. Of course, the pickling fluid functions to quench the rod as well as to perform the desired pickling function. Also, the water utilized in the system functions to further cool the rod as well as to clean the acid from the surface of the rod.

By increasing the wet path of the acid conduit a lower acid concentration can be used, and when a higher acid concentration is used, a shorter acid path can be used. In order to achieve optimum quench-pickling, the acid concentration during the most rapid and high temperature portion of the quenching of the rod should be high enough to pickle the rod. The optimum range of acid concentration in citric acid pickling solutions has been found to be from 5 percent to 25 percent acid, with lower acid concentrations not functioning adequately to properly pickle the rod as the quenching occurs and with little improvement in rod texture being achieved with higher concentrations. The temperature of the water and acid solutions and the length of the wet path should be sufficient to reduce the temperature of the rod to below 200° F. to prohibit reoxidation of the rod. For instance, with the temperature of the pickling solutions and water at 140° F. going into the conduit and at 170° F. coming out, or an average temperature of 155 degrees for both liquids, and with a production rate of 12.5 tons of rod per hour or 1232 feet per minute of rod through the conduit, with water and acid passing at a rate of 125 gallons per minute through the conduit, and with the rod entrance temperature of 1100° F., the temperature of the rod from a 21 foot conduit is 193° Fahrenheit, from a 30 foot conduit is 164° F., and from a 40 foot conduit is 157° F. The entrance temperature of the rod can be reduced to below 700° F. and the quench-pickling of the rod will still produce an acceptably pickled product.

While a 10 percent citric acid solution has been utilized and is considered to be within the optimum range of acid concentration for the purpose set forth, it should be understood that various other acid concentrations may be utilized, as well as different pickling solutions, such as tartaric acid, gluconic acid, sulfuric acid, and itaconic acid, as well as other solutions of aconitic, citraconic, or other acidic derivatives from thermal citric acid decomposition. Generally speaking, the pickling solution should be non-toxic, less aggressive than mineral acids, and should be an excellent sequestering agent. Of course, the acid concentration and flow characteristics of the system can be adjusted for the particular acid being utilized in the system.

While air has been disclosed as the "wiping" fluid in the various air nozzles, it should be understood that steam and various other gases are suitable for the process and usable with the values illustrated.

While the system has been set forth in specific detail as relating to continuous casting of rod, it will be understood by those skilled in the art that the concept of continuously treating the rod is applicable to other products, including flat stock, tubing and other copper products. Furthermore, the quench-pickling treatment can be used in a non-continuous process, by reheating a rod or other copper product and immersing the product in a pickling solution as a batch, or by continuously passing the product through a solution. It is not necessary that the product retain its residual heat from its casting process, since the process functions adequately when the product has been reheated.

While a water soluble wax has been disclosed as being applied to the rod as it passes through wax applicator 22, a soluble oil solution or other preservative liquid can be applied to the rod at this point desired.

At this point, it should be apparent that the quench-pickling process herein disclosed provides a continuous method of pickling copper rod without the necessity of the usual expensive equipment required in the old batch process. The surface texture of the rod treated in this manner is superior to the batch process, and the coils formed from the rod can be wound very densely to form smaller packages which are more convenient to handle and less expensive to ship since it is not necessary to circulate the pickling solution through the coiled rod.

It will be obvious to those skilled in the art that many variations may be made in the embodiments chosen for the purpose of illustrating the present invention without departing from the scope thereof as defined by the appended claims.

We claim:

1. In apparatus for continuously forming copper rod or the like including casting means for forming a copper bar, rolling means for lengthening and reducing the cross-sectional area of the bar to form rod, coiling means for coiling the rod, means for quench-pickling the rod as the rod passes from the rolling means to the coiling means, said quench-pickling means including for impinging the rod with a flow of high velocity pickling agent; means for causing the pickling agent to flow in counterflow relation to the movement of the rod, and means for directing a jet of air along the length of the rod to wipe the pickling agent therefrom.

2. In apparatus for continously forming metal rod including a casting machine, a rolling mill, and a coiler, the combination therewith of means for passing rod along its length though a predetermined path, means for wiping the rod with a flow of high velocity fluid at a first station, means for impinging the rod with a flow of high velocity pickling sequestering agent at a second station, means for flowing pickling sequestering agent in contact with and along the length of the rod in the direction opposite to the movement of the rod from a third station toward the second station, means for flowing pickling sequestering agent in contact with and along the length of the rod from a fourth station toward the third station, means for impinging the rod with a flow of high velocity pickling sequestering agent at a fifth station, means for alternately wiping the rod with flows of air and water at a sixth station, means for flowing water in contact with and along the length of the rod from a seventh station toward the sixth station, and means for coating the surface of the rod with a protective material at an eighth station.

3. In apparatus for continuously forming metal rod including a casting machine, a rolling mill, and a coiler, the combination therewith of a housing including a rod entrance wall and a rod exit wall and being divided into at least two chambers by at least one partition, said housing entrance and exit walls and said partition each defining aligned apertures therein for receiving rod therethrough, air flow means in the chamber adjacent said entrance wall for flowing air into contact with and along the rod in a direction generally opposite to the movement of the rod through the housing, said first air flow means being positioned at said entrance wall and arranged to flow air from within said housing through said entrance wall, fluid flow means in the chamber adjacent said exit wall for flowing rod pickling fluid into contact with the rod in a direction generally across the movement of the rod through the housing.

4. The invention of claim 3 and further including second air flow means adjacent said partition for flowing air into contact with and along the rod in a direction generally along the movement of the rod through the housing.

5. The invention of claim 3 wherein said exit wall includes a tube surrounding the aperture of the exit wall for receiving the rod passing through said housing and for flowing pickling fluid into the housing, and drain means connected to the chamber adjacent the exit wall.

6. In apparatus for continuously forming metal rod including a casting machine, a rolling mill, and a coiler, the combination therewith of a housing defining aligned apertures opening therethrough for passing rod along a predetermined path through the housing, tubular conduits extending away from opposite sides of the housing in alignment with the apertures of said housing, first fluid flow means positioned adjacent the path for flowing rod pickling fluid into contact with and along the length of the rod, said first fluid flow means being arranged to flow the rod pickling fluid through one of said conduits away from said housing, second fluid flow means positioned adjacent the path for flowing rod pickling fluid into contact with and along the length of the rod, said second fluid flow means being arranged to flow the rod pickling fluid into said housing, and drain means connected to said housing for draining the rod pickling fluid from said housing.

7. The invention of claim 6 wherein both said first and second fluid flow means are arranged to flow rod pickling fluid in a direction along the rod which is opposite to the direction of movement of the rod through said housing.

8. The invention of claim 6 wherein said second fluid flow means is constructed and arranged to induce a fluid flow through the other of said conduits toward said housing.

9. In apparatus for continuously forming metal rod including a casting machine, a rolling mill, and coiler, the combination therewith of a housing defining aligned apertures therethrough for the passage of the rod along a predetermined path extending through the apertures, a first tubular conduit communicating with one end of said housing and in alignment with the path, first fluid flow means adjacent the path for flowing rod pickling fluid into contact with and along the length of the rod, said first flow means being constructed and arranged to flow the rod pickling through said first tubular conduit in a direction away from said housing, a first chamber defined in said housing, second fluid flow means communicating with said first chamber for impinging the rod with a high velocity flow of pickling fluid in a direction generally transverse to the path, a second chamber defined in said housing, first air flow means adjacent the path for flowing air into contact with and along the length of the rod, said first air flow means being constructed and arranged to flow air in a direction from said second chamber toward said first chamber, second air flow means communicating with said second chamber and adjacent the path for flowing air into contact with and along the length of the rod, a third chamber defined in said housing, third air flow means adjacent the path for flowing air into contact with and along the length of the rod, said third air flow means being constructed and arranged to flow air in a direction from said second chamber toward said third chamber, two liquid flow means for flowing water into contact with and along the length of the rod, said liquid flow means being positioned between said first and second air flow means and between said second and third air flow means, a third liquid flow means communicating with said third chamber for impinging the rod with a high velocity flow of water in a direction generally transverse to the path, a second tubular conduit communicating with the other end of said housing and in alignment with the path and arranged to direct fluid flowing therethrough into said third chamber.

10. In apparatus for continuously forming metal rod including a casting machine, a rolling mill, and a coiler, the combination therewith of a housing defining aligned apertures therethrough for the passage of the rod along a rectilinear path extending through the apertures, said housing being divided by partitions into a series of chambers extending along the path, the chamber at one end of the housing including fluid flow means arranged to flow pickling fluid into contact with the rod, the chamber at the other end of the housing including liquid flow means arranged to flow water into contact with the rod, and at least one of the chambers between the end chambers including a series of air flow means and liquid flow means arranged to alternately flow air and water into contact with the rod.

11. The invention of claim 10 wherein said air flow means of the series of air flow means and liquid flow means are arranged to flow air into each of the end chambers.

12. In apparatus for continuously forming metal rod including a casting machine, a rolling mill, and a coiler, the combination therewith of a housing, an open path defined through said housing for the passage of rod, a tubular conduit connected to said housing and in alignment with the path for guiding the rod toward said housing, liquid flow means adjacent the path and arranged to flow water into contact with and along the length of the rod, said liquid flow means being arranged to flow water through said conduit in a direction away from said housing, gas flow means adjacent the path and arranged to flow air into contact with and along the length of the rod, said gas flow means being arranged to flow air from outside said housing in a direction toward said housing.

* * * * *

UNITED STATES PATENT OFFICE

CERTIFICATE OF CORRECTION

Patent No. 4,005,744 Dated February 1, 1977

Inventor(s) D. B. Cofer, E. C. Chia, J. E. Burnitt, T. W. Kaltenberg

It is certified that error appears in the above-identified patent and that said Letters Patent are hereby corrected as shown below:

Column 3, line 47; "will" should be --wall--.

Column 6, line 24; "tod" should be --rod--.

Column 7, line 26; "red" should be --rod--.

Column 7, line 48; after "injection" add --chamber--.

Column 8, line 9; "MAX APPLICATION" should be --WAX APPLICATOR--.

Column 8, line 24; after "is" add --such--.

Column 8, line 41; add --excess-- before "wax".

In Claim 1, column 12, line 50; after "including" add --means--.

Signed and Sealed this

Seventh Day of March 1978

[SEAL]

Attest:

RUTH C. MASON
Attesting Officer

LUTRELLE F. PARKER
Acting Commissioner of Patents and Trademarks